US010858740B2

(12) United States Patent
Möller et al.

(10) Patent No.: US 10,858,740 B2
(45) Date of Patent: Dec. 8, 2020

(54) SYSTEMS AND METHODS FOR MODIFYING SURFACES OF SUBSTRATES

(71) Applicants: SIEMENS AKTIENGESELLSCHAFT, Munich (DE); DANMARKS TEKNISKE UNIVERSITET, Kgs. Lyngby (DK)

(72) Inventors: Per Möller, Esrum (DK); Asger Andersen, Kopenhagen (DK); Sara Eisenhardt, Frederiksberg (DK); Kasper Bondo Hansen, Lyngby (DK); Martin Kalmar Hansen, Vanløse (DK); Melanie Thyrhaug, Kopenhagen (DK)

(73) Assignee: Siemens Aktiengesellschaft, Munich (DE)

( * ) Notice: Subject to any disclaimer, the term of this patent is extended or adjusted under 35 U.S.C. 154(b) by 242 days.

(21) Appl. No.: 15/761,912

(22) PCT Filed: Sep. 24, 2015

(86) PCT No.: PCT/EP2015/071993
§ 371 (c)(1),
(2) Date: Mar. 21, 2018

(87) PCT Pub. No.: WO2017/050378
PCT Pub. Date: Mar. 30, 2017

(65) Prior Publication Data

US 2018/0265986 A1 Sep. 20, 2018

(51) Int. Cl.
*C23C 22/78* (2006.01)
*B24C 1/04* (2006.01)
(Continued)

(52) U.S. Cl.
CPC ..... *C23C 22/78* (2013.01); *B24C 1/04* (2013.01); *B24C 7/0046* (2013.01);
(Continued)

(58) Field of Classification Search
None
See application file for complete search history.

(56) References Cited

U.S. PATENT DOCUMENTS

2002/0042991 A1 4/2002 Kim
2008/0124467 A1 5/2008 Chapel
2010/0211158 A1* 8/2010 Haverty ..... B24C 1/10 623/1.15

FOREIGN PATENT DOCUMENTS

CN 1357686 A 7/2002
CN 101410334 A 4/2009
(Continued)

OTHER PUBLICATIONS

Chinese Office Action for Chinese Application No. 201580083368.1 dated Aug. 7, 2019.
(Continued)

*Primary Examiner* — Shamim Ahmed
*Assistant Examiner* — Bradford M Gates
(74) *Attorney, Agent, or Firm* — Lempia Summerfield Katz LLC

(57) ABSTRACT

The present disclosure presents a method and a system for modifying a surface of a substrate. The method includes an act of abrasive blasting of a part of the surface of the substrate. In the abrasive blasting, an abrasive media is provided to the part of the surface. The abrasive media is carried to the part by a first carrier. The abrasive media collides with the part of the surface and causes abrasion to
(Continued)

the part of the surface. In the method, the first carrier includes steam. The steam of the first carrier heats the part of the surface.

15 Claims, 4 Drawing Sheets

(51) Int. Cl.

| | |
|---|---|
| ***B24C 7/00*** | (2006.01) |
| ***B24C 11/00*** | (2006.01) |
| ***C23C 22/76*** | (2006.01) |
| ***C23C 22/00*** | (2006.01) |

(52) U.S. Cl.
CPC ..... *B24C 11/005* (2013.01); *C23C 22/00* (2013.01); *C23C 22/76* (2013.01)

(56) References Cited

FOREIGN PATENT DOCUMENTS

| | | | |
|---|---|---|---|
| CN | 101535003 | A | 9/2009 |
| CN | 102615058 | A | 8/2012 |
| RU | 2050251 | C1 | 12/1995 |
| WO | 8504614 | A1 | 10/1985 |

OTHER PUBLICATIONS

PCT International Search Report dated May 31, 2016 and corresponding to PCT International Application No. PCT/EP2015/071993 filed Sep. 24, 2015.

* cited by examiner

SYSTEMS AND METHODS FOR MODIFYING SURFACES OF SUBSTRATES

The present patent document is a § 371 nationalization of PCT Application Serial Number PCT/EP2015/071993, filed Sep. 24, 2015, designating the United States, which is hereby incorporated by reference.

TECHNICAL FIELD

The present disclosure relates to a technique for modifying a surface of a substrate, and more particularly to a method and a system for modifying a surface of a substrate.

BACKGROUND

Surface modifications or modifications of surfaces, (such as laminates, metallic alloys surfaces, metal surfaces, etc.), have been long employed in related industries. Surface modification includes bringing, to a surface of a substrate, physical or chemical characteristics that are different from the ones originally found on the surface of a material before subjecting the surface to the surface modification. One example of surface modification is cleaning the surface by getting rid of any unwanted deposits, such as dirt or oxidized layers, (e.g., rust, etc.). Surface modification also includes preparing the surface, (e.g., smoothening a rough surface, roughening a smooth surface, shaping a surface, removing surface contaminants, and so on and so forth), for further processes downstream. Modification may also include the downstream processes such as coating the surface after it has been prepared.

Modification of surfaces is done in various ways, for example, by using sandpaper or glasspaper, a type of coated abrasive that includes sheets of paper or cloth with abrasive material glued to one face and is used to remove small amounts of material from surfaces, either to make them smoother, to remove a layer of material (such as old paint or rust or other oxidization products), or sometimes to make the surface rougher (for example, as a preparation for the downstream process of surface modification such as gluing). Another way of surface modification is abrasive blasting. In abrasive blasting, a stream of abrasive material, also referred to as abrasive media, is forcibly propelled against a surface of a substrate under high pressure to smoothen a rough surface, roughen a smooth surface, shape a surface, remove surface contaminants, and so on and so forth.

After cleaning the surface or preparing the surface, (for example, by abrasive blasting), the surface may be subjected to other surface modification methods, say downstream surface modifications, such as coating the surface. Many of the further uses of a surface subjected to surface modification or many of the downstream surface modifications may be facilitated or positively affected if the surface and/or surroundings of the surface are at a raised or higher temperature. One example of such surface modification process used downstream after abrasive blasting of the surface and that is facilitated by raised temperature of the surface and/or the surroundings of the surface is a process of chemical conversion coating. In the process of chemical conversion coating, used mainly for metallic surfaces, a part of the metallic surface is converted into the coating with a chemical or electro-chemical process, for example, by using an additive that reacts with the substrate at the surface and forms a layer, on the surface, of a new material such as a mineral of the additive and the substrate. Examples of chemical conversion coating include chromate conversion coatings especially used for aluminum alloy surfaces, phosphate conversion coatings, bluing, black oxide coatings on steel, and anodizing. The chemical conversion coatings are used for corrosion protection, increased surface hardness, to add decorative color, as adhesion promoter primers, and so on and so forth. The rate at which the process of building up of the coat, e.g., the layer of the new material or the mineral, on the surface of the substrate takes place is increased with increasing temperature within a defined range.

However, the presently used surface modification processes either do not heat up the surface and/or the surroundings of the surface at all or do not heat up the surface and/or the surroundings of the surface to a desired degree. Thus, the downstream processes that are facilitated by heat or by raised temperatures of the surface and/or the surroundings of the surface occur at a slower rate or may require additional acts and hardware for heating or providing heat to the surface and/or the surroundings of the surface before or during these downstream processes.

SUMMARY AND DESCRIPTION

The object of the present disclosure is to provide a technique, in particular a method and a system, for modifying a surface of a substrate in such a way that the surface and/or the surroundings of the surface are heated up simultaneously along with other acts of surface modification. The technique is desired to be simple and cost effective. Furthermore, the system of the technique is desired to be compact.

The scope of the present disclosure is defined solely by the appended claims and is not affected to any degree by the statements within this summary. The present embodiments may obviate one or more of the drawbacks or limitations in the related art.

According to an aspect of the present technique, a method for modifying a surface of a substrate is presented. The method includes an act of abrasive blasting of a part of the surface of the substrate. In the abrasive blasting, an abrasive media is provided to the part of the surface. The abrasive media is carried to the part by a first carrier. The abrasive media collides with the part of the surface and causes abrasion to the part of the surface. In the method, the first carrier includes steam. The steam of the first carrier heats the part of the surface. Thus, the part of the surface which may be subjected to any further modification is preheated by the steam of the first carrier during abrasive blasting, and the pre-heated surface facilitates further modifications of the type that are facilitated by heat or by higher ambient temperatures when such further modifications are performed on the part of the surface of the substrate.

In an embodiment of the method, the method includes providing an additive to the part of the surface of the substrate. The additive is carried to the part by a second carrier. The additive interacts with the surface to form a coating, for example, the additive reacts with the substrate to form a chemical conversion coating, on the part of the surface of the substrate. Thus, the part of the surface forms the coating or the chemical conversion coating which protects the surface from corrosion or provides special properties, such as higher heat resistance, through the chemical conversion coating. When forming the chemical conversion coating, the formation of the coating is facilitated by heat or by higher ambient temperatures, and because the part was preheated by steam of the first carrier, a rate of formation of the chemical conversion coating is increased.

In another embodiment of the method, the second carrier includes steam. Thus, the part of the surface is further heated by the steam of the second carrier. The rate of formation of the chemical conversion coating is further increased.

In another embodiment of the method, the steam included in the first carrier and/or the steam included in the second carrier is saturated steam.

In another embodiment of the method, the steam included in the first carrier and/or the steam included in the second carrier is superheated steam.

In another embodiment of the method, the superheated steam is generated by burning a fuel, for example, fuel having hydrogen or hydrocarbon, in form of a burning mixture and injecting saturated steam or atomized water into the burning mixture. The saturated steam or atomized water injected into the burning mixture means injected directly into the burning mixture or injected in proximity of the burning mixture such that burning fuel has an effect on the saturated steam or atomized water, for example, an effect of raising a temperature.

In another embodiment of the method, the steam of the first carrier and the steam of the second carrier are received from a common source of steam. Thus, the method is economically implemented and requires lesser components to implement, thereby making the method simple and cost effective.

In another embodiment of the method, the common source of steam is operated at a pressure ranging between 3 bars and 30 bars, or between 8 bars and 17 bars. This provides an advantageous range of pressure for the steam used in the method. The pressure of the steam facilitates the projection of the abrasive media and/or the additive on to the part of the surface. The pressure also helps in imparting a force to the abrasive media which is required for effective collision of the abrasive media with the part of the surface and thus abrasion of the part of the surface by the colliding abrasive media is increased.

In another embodiment of the method, the common source of steam is operated at a temperature ranging between 100 degrees Celsius and 300 degrees Celsius. This provides an advantageous range of temperature for the steam used in the method. The temperature of the steam provides heat that is transferred to the part by the steam of the first carrier and/or the steam of the second carrier thereby facilitates the heating of the part of the surface.

In another embodiment of the method, the method includes providing a protective environment to the part of the surface after abrasive blasting and before providing additive to the part of the surface or simultaneously with abrasive blasting, e.g., while abrasive blasting is being performed. The protective environment is provided by enveloping the part of the surface with a non-reactive material, (e.g., a noble gas such as nitrogen), or by enveloping the part of the surface with a reducing material, such as a reducing gas, (e.g., carbon monoxide gas or hydrogen gas). Thus, the part of the surface that has been subjected to abrasive blasting is protected from surrounding factors, for example, ambient air which may promote undesired oxidation of the substrate in the part of the surface, or from dirt present in the ambient air which may get deposited on the part of the surface and interfere with the formation of the coating or the chemical conversion coating in the act of providing additives to the part of the surface. When using the reducing gas, the part of the surface that has been subjected to abrasive blasting if gets oxidized again prior to formation of the coating, then the part of the surface is reduced by the reducing gas before providing additives to the part of the surface.

In another embodiment of the method, the method further includes providing the substrate wherein the substrate is a metallic substrate. Thus, the method is used with metallic substrates and the effectiveness of the method is increased because the metallic substrates are at least partially cleaned by the abrasive blasting and are more heated than non-metallic substrates such as ceramics.

In another embodiment of the method, the metallic substrate includes aluminum and/or magnesium, including aluminum-magnesium alloys. Thus, the method is used with aluminum and/or magnesium substrates including aluminum alloys and/or magnesium alloys and the effectiveness of the method is increased because the aluminum and/or magnesium substrates are at least partially cleaned by the abrasive blasting of undesired surface layers such as aluminum oxide layers formed on the aluminum substrate. The method becomes especially effective because aluminum is a soft metal.

In another embodiment of the method, the abrasive media includes one of alumina grits, steel-based grits, quarts or sand, silicon carbide, ceramic granules, plastic, and a combination thereof. This provides a simple way of implementing the method as the abrasive media are easily available. Furthermore, the abrasive media are inexpensive, and this the method becomes more cost effective.

According to another aspect of the present technique, a system for modifying a surface of a substrate is presented. The system includes an abrasive blasting module and an additive providing module. The abrasive blasting module provides an abrasive media to a part of the surface of the substrate. The abrasive media is carried to the part by a first carrier ejected, along with the abrasive media, from the abrasive blasting module. The first carrier includes steam. The additive providing module provides an additive to the part of the surface of the substrate. The additive is carried to the part by a second carrier ejected, along with the additive, from the additive providing module. The additive interacts with the substrate to form a coating, (e.g., the additive reacts with the substrate to form a chemical conversion coating), on the part of the surface of the substrate. The steam of the first carrier that is provided by the abrasive blasting module heats up the part of the surface. Thus, when the part of the surface is subjected to further modification by providing the additives by the additive providing module, the part is preheated by the steam of the first carrier during abrasive blasting, and the pre-heated surface facilitates and/or higher ambient temperatures facilitate the formation of the coating or the chemical conversion coating.

In an embodiment of the system, the second carrier includes steam. Thus, the part of the surface is further heated by the steam of the second carrier provided by the additive providing module. The rate of formation of the coating is further increased.

In another embodiment of the system, the abrasive blasting module and the additive providing module are in fluid communication with a common source of steam. Thus, the steam of the first carrier and the steam of the second carrier are received or obtained from the common source of steam. This makes the system simple. Because the system is implemented using the common source of steam, the system does not need two separate supplies, and related hardware, for the two carriers (e.g., the first carrier and the second carrier). This makes the system cost-effective and compact.

In another embodiment of the system, the system includes a moving mechanism. The moving mechanism implements a change in relative orientation between the part of the surface of the substrate with respect to the abrasive blasting module and the additive providing module. The change in the relative orientation of the part with respect to the abrasive blasting module and the additive providing module may either be achieved by moving only the part while the abrasive blasting module and the additive providing module remain stationary, or by only moving the abrasive blasting module and the additive providing module together and the part remains stationary, or by a combination of simultaneously moving the part along with the abrasive blasting module and the additive providing module. In this embodiment of the system, the abrasive blasting module and the additive providing module are in a fixed orientation relative to each other. Thus, the system may be used for continuously modifying several parts on the surface of the substrate. Furthermore, the abrasive blasting module and the additive providing module may be operated simultaneously. When operated simultaneously, when the abrasive blasting module has performed abrasive blasting on the part, say first part, the first part is moved by the moving mechanism to align with the additive providing module, and while the additive providing module performs on the first part, another part, say the second part, of the surface of the substrate may be aligned with the abrasive blasting module which may perform abrasive blasting on the second part while the additive providing module is performing on the first part.

In another embodiment of the system, the system further includes a pre-coating protection module. The pre-coating protection module provides a non-reactive and/or a reducing material to the part of the surface of the substrate such that the non-reactive material envelops the part of the surface of the substrate. The non-reactive material may be any material that is inert to the substrate, (e.g., a noble gas such as nitrogen). The reducing material may be any material that reduces an oxidized form of the substrate. For example, the reducing material may be a reducing gas, such as carbon monoxide, that chemically reduces an oxidized substrate, such as ferric oxide where iron is the substrate and the ferric oxide is the oxidized from of the substrate. Thus, the part of the surface that has been subjected to abrasive blasting by the abrasive blasting module is protected from surrounding factors, for example, ambient air which may promote undesired oxidation of the substrate in the part of the surface, or from dirt present in the ambient air which may get deposited on the part of the surface and interfere with the formation of the coating or the chemical conversion coating by the additive providing module.

BRIEF DESCRIPTION OF THE DRAWINGS

The present technique is further described hereinafter with reference to illustrated embodiments shown in the accompanying drawing, in which.

DETAILED DESCRIPTION

Figure 1:
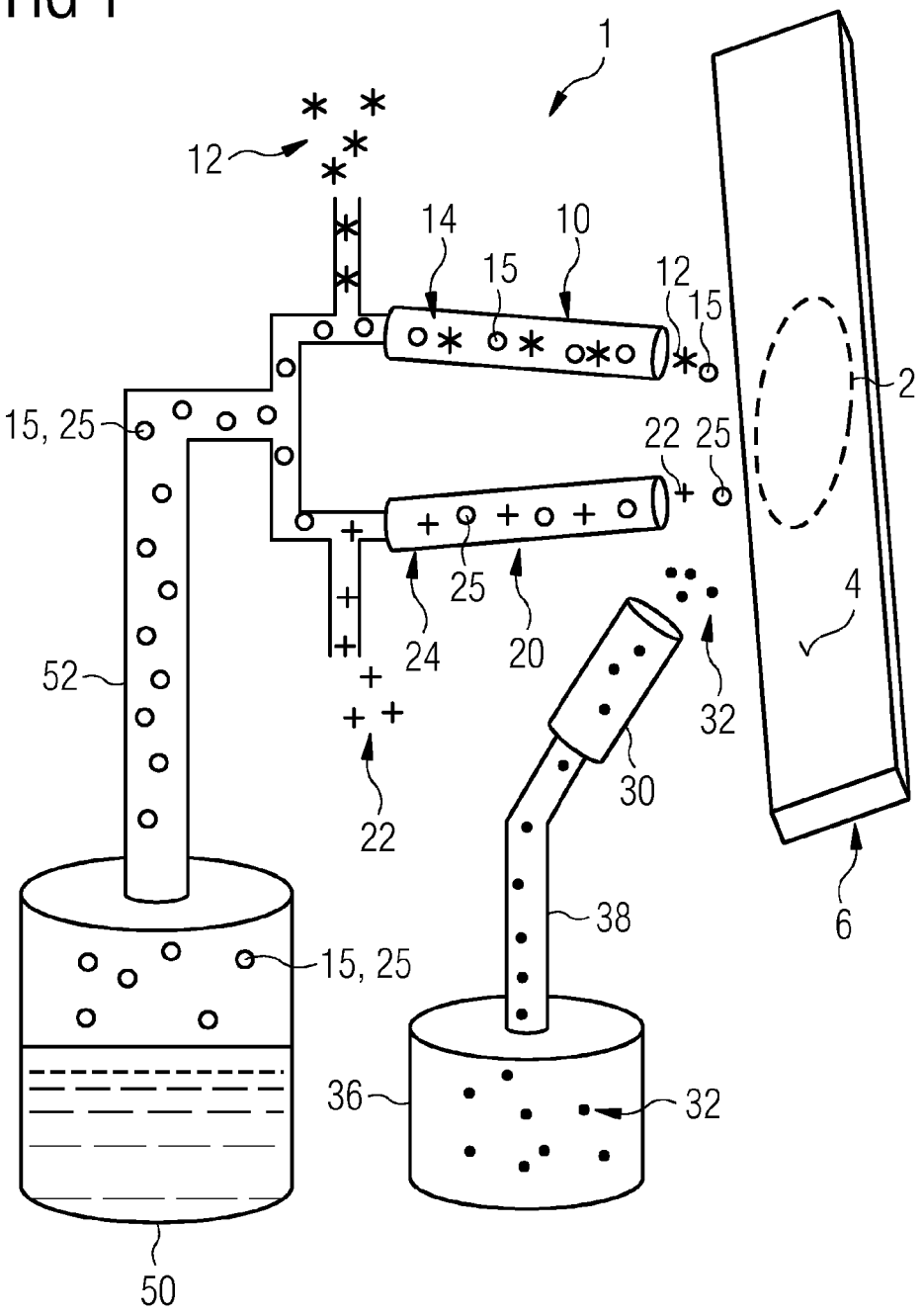
FIG. 1 schematically illustrates an exemplary embodiment of a system for modifying a surface of a substrate.

Hereinafter, above-mentioned and other features of the present technique are described in the details below. Various embodiments are described with reference to the drawing, wherein like reference numerals are used to refer to like elements throughout. In the following description, for purpose of explanation, numerous specific details are set forth in order to provide a thorough understanding of one or more embodiments. It may be noted that the illustrated embodiments are intended to explain, and not to limit the disclosure. It may be evident that such embodiments may be practiced without these specific details.

It may be noted that in the present disclosure, the terms "first", "second", etc. are used herein only to facilitate discussion, and carry no particular temporal or chronological significance unless otherwise indicated.

The idea of the present technique is a surface modification in which at least an act of abrasive blasting is performed by using steam along with an abrasive media propelled towards the surface to be modified. So along with the abrasive media, the steam also interacts with the surface to be modified and the result is that the surface gets modified by the abrasive media and gets heated by the steam. Thus, for further acts of surface modification or for later use of the surface for another processes where such further acts of surface modification and/or such another processes making later use of the surface are facilitated by heat or elevated temperatures, the surface and/or its surroundings or ambience or adjacent atmosphere are at an elevated temperature and thus such further acts of surface modification and/or such another processes are facilitated.

Figure 8:
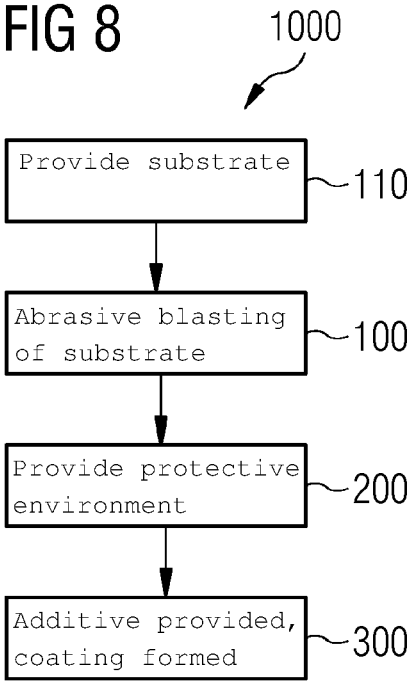
FIG. 8 depicts a flow chart of an exemplary embodiment of a method for modifying a surface of a substrate; in accordance with aspects of the present technique.

The technique has been explained hereinafter in greater details with reference to FIGS. 1 and 8, which respectively present a system 1 and a method 1000 of the present technique.

FIG. 1 schematically presents an exemplary embodiment of the system 1 for modifying a surface 4 of a substrate 6. The substrate 6 may be a metallic substrate, (e.g., aluminum alloy) or may be a non-metallic substrate, (e.g., composites like laminates). The phrase 'modifying a surface' and related phrases as used hereinafter, include, but are not limited to, providing to or bringing in, to the surface 4 of the substrate 6, physical or chemical characteristics that are different from the ones originally found on the surface 4 of the substrate 6 before subjecting the surface 4 of the substrate 6 to the surface modification. For example, 'modifying a surface' and related phrases include, removing some material, whether same as the substrate 6 or otherwise, from the surface 4 of the substrate 6; adding some material, whether same as the substrate 6 or otherwise, to the surface 4 of the substrate 6; or a combination thereof, e.g., removing some material and adding some material, in which the material removed and added may be same or different to one another and each of the material may be same or different as the material of the substrate 6.

The system 1 includes an abrasive blasting module 10 and an additive providing module 20. The abrasive blasting module 10 provides an abrasive media 12 to a part 2 of the surface 4 of the substrate 6. The abrasive media 12 is carried by a first carrier 14. The first carrier 14 includes steam 15.

The abrasive blasting module 10 performs abrasive blasting on the part 2 of the surface 4 of the substrate 6. The abrasive blasting module 10 forcibly propels a stream of the abrasive media 12, also referred to as the abrasive material 12, towards the part 2 of the surface 4. The force with which the abrasive media 12 is propelled towards the part 2 of the surface 4 comes from the first carrier 14. The first carrier 14 includes the steam 15. The first carrier 14 may also include other parts such as compressed air (not shown) or pressurized air. A part of the energy required to propel or shoot the abrasive media 12 from the abrasive blasting module 10 towards the part 2 of the surface 4 may be contributed by the steam 15 of the first carrier 14. Advantageously, the steam 15 may be pressurized.

The abrasive media 12 may be any substance in granular or gritty form that is physically hard enough to remove a material, whether same as the material of the substrate 6 or different than the material of the substrate 6, from the surface 4, mainly from the part 2 of the surface 4 of the substrate 6. The abrasive media 12, also referred to as grits 12, is chosen depending upon the material to be removed. For example, when the substrate 6 is aluminum, or an alloy of aluminum such as Al6060, the material to be removed may be an undesirable layer of aluminum oxide formed by oxidation of the surface 4 of the aluminum substrate 6 or may be simply part of the aluminum substrate 6 that may be desired to be removed from the part 2 of the surface 4 to prepare the surface 4 or the part 2 of the surface 4 for further processing such as application of chemical conversion coating. The abrasive media 12 may be, but not limited to, alumina grits, steel-based grits, sand, silicon carbide, ceramic granules, and a combination thereof.

The abrasive blasting module 10 is designed as a module or unit or part of the system 1 having an opening or a nozzle (not shown) from which the abrasive media 12 is propelled from carried by or along with the first carrier 14 released with a force towards the part 2 of the surface 4. From the same nozzle or opening, the steam 15 is also released as constituent of the first carrier 14. In an exemplary embodiment, the first carrier 14 may be only the steam 15, and in this embodiment, the force with which the abrasive media 12 is propelled by the abrasive blasting module 10 may entirely be contributed by the steam 15. The steam 15 may be pressurized between 3 and 30 bars, between 8 to 20 bars, or between 8 to 17 bars at the release of the steam 15 from the abrasive blasting module 10. Furthermore, the steam 15 may be heated to temperatures such that at the release of the steam 15 from the abrasive blasting module 10, the temperature of the steam 15 is between 100 degrees Celsius (° C.) and 300° C. The steam 15 may be generated at a steam generating unit (not shown), which is capable of generating and controlling steam at desired pressures and/or temperatures. Such steam generating units, for example, boilers with pressure valves and temperature sensors are known in the art of boilers and steam generation for industrial use, and thus have not been described in detail herein for sake of brevity.

The propelled abrasive media 12 collides with the part 2 of the surface 4 of the substrate 6 and chips away or scrapes or abrades materials, same as the material of the substrate 6 or otherwise or both, from the part 2 of the surface 4. Thus, a physical change is introduced or brought into the part 2 of the surface 4 of the substrate 6 which at least partially forms the surface modification of the surface 4 of the substrate 6. Simultaneously, the steam 15 also hits or physically contacts the part 2 of the surface 4 and thus the part 2 of the surface 4 gets heated and has a raised temperature compared to an instance of abrasive blasting where the steam 15 is not used. As shown in FIG. 1, the steam 15 and the abrasive media 12 are mixed with each other before propelling out the steam 15 and the abrasive media 12 together towards the part 2 of the surface 4 of the substrate 6.

The additive providing module 20, of the system 1, provides an additive 22 to the part 2 of the surface 4 of the substrate 6. The additive 22 is carried by a second carrier 24. The additive 22 reacts with the substrate 6 in the part 2 to form a coating (not shown) or a chemical conversion coating 27 (shown in FIG. 7) on the part 2 of the surface 4 of the substrate 6. The second carrier 24 may include steam 25.

The additive providing module 20 performs propelling of the additive 22 towards the part 2 of the surface 4. The propelling may be in form of a spray or a mist, wherein the additive 22 is dissolved in the second carrier 24 or simply as a stream of the additive 22 carried in granular form by the second carrier 24. The force with which the additive 22 is propelled towards the part 2 of the surface 4 comes from the second carrier 24. The second carrier 24 may also include other parts such as compressed air (not shown) or pressurized air or solvents of parts of the additive 22. A part of the energy required to propel or shoot the additive 22 from the additive providing module 20 towards the part 2 of the surface 4 may be contributed by the steam 25 of the second carrier 24, when the steam 25 is part of the second carrier 24. Advantageously, the steam 25 may be pressurized.

The additive 22 may be any substance or a collection of different substances having at least one substance that interacts physically and/or chemically with the substrate to form the coating (not shown) on the part 2 of the surface 4 of the substrate 6. The substance or the at least one substance that interacts with the substrate 6 may interact with the substrate 6 in a physical reaction to form the coating or in a chemical reaction to build up the chemical conversion coating 27 (shown in FIG. 7). The additive 22 may also include additional components such as chemicals that stabilize the coating or the chemical conversion coating 27, or attribute special characteristics to the coating or the chemical conversion coating 27 such as decreasing porosity, hardening, accelerating the formation of the coating or the chemical conversion coating 27, inhibiting corrosion, and so on and so forth. The additive 22 is chosen depending upon the material of the substrate 6. For example, when the substrate 6 is aluminum alloy, (e.g., Al6060), the additive 22 may include phosphate including substance which chemically interacts with the aluminum 6 and forms Berlinite (aluminum phosphate, chemical formula $AlPO_4$) as the chemical conversion coating 27. For another example, when the substrate 6 is aluminum alloy, (e.g., Al6060), the additive 22 may include silicate including substance which chemically interacts with the aluminum 6 and forms Kaolinite (aluminum silicate, chemical formula $Al_2Si_2O_5$) as the coating 27. Furthermore, the additive 22 may include substances that further modify the chemical conversion coating 27 by acting as catalyst, e.g., for accelerating a rate of formation of the chemical conversion coating 27, or by acting as a passivation material or corrosion inhibiters that decrease a rate of corrosion of the coating 27, and so on and so forth.

The additive providing module 20 is designed as a module or unit or part of the system 1 having an opening or a nozzle (not shown) from which the additive 22 is provided to or propelled from carried by or along with the second carrier 24 released with a force towards the part 2 of the surface 4. From the same nozzle or opening, the steam 25 is also released as constituent of the second carrier 24. In an exemplary embodiment, the second carrier 24 may be only the steam 25, and in this embodiment, the force with which the additive 22 is provided by the additive providing module 20 may entirely be contributed by the steam 25. The steam 25 may be pressurized between 3 and 30 bars, between 8 to 20 bars, or between 8 to 17 bars at the release of the steam 25 from the additive providing module 20. Furthermore, the steam 25 may be heated to temperatures such that at the release of the steam 25 from the additive providing module 20, the temperature of the steam 25 is between 100° C. and 300° C. The steam 25 may be generated at a steam generating unit (not shown), which is capable of generating and controlling steam at desired pressures and/or temperatures. Such steam generating units, for example, boilers with pressure valves and temperature sensors are known in the art of boilers and steam generation for industrial use, and thus have not been described in detail herein for sake of brevity.

The propelled additive 22 interacts with the part 2 of the surface 4 of the substrate 6 and forms, (e.g., by mineralization or deposition), the chemical conversion coating 27 or the coating on the surface 4 in the part 2 of the surface 4. Thus, a physical change and/or chemical change is introduced or brought into the part 2 of the surface 4 of the substrate 6 which at least partially forms the surface modification of the surface 4 of the substrate 6. Simultaneously, when the second carrier 24 includes the steam 25, the steam 25 also hits or physically contacts the part 2 of the surface 4 and thus the part 2 of the surface 4 gets further heated and has a further raised temperature compared to an instance of adding additives 22 where the steam 25 is not used. As shown in FIG. 1, the steam 25 and the additive 22 are mixed with each other before propelling out the steam 25 and the additive 22 together towards the part 2 of the surface 4 of the substrate 6. The raised temperate in the part 2 facilitates formation of the coating 27.

Furthermore, as seen in FIG. 1, in an exemplary embodiment of the system 1 the abrasive blasting module 10 and the additive providing module 20 are in fluid communication with a common source of steam 50. Thus, the steam 15 of the first carrier 14 and the steam 25 of the second carrier 24 are derived or received or generated from the same source, e.g., the common source of steam 50. The common source of steam 50 may be, but not limited to, a boiler. The common source of steam 50 may be connected to the abrasive blasting module 10 and the additive providing module 20 through a fuel supply line 52 through which the steam 15, 25 flows to the abrasive blasting module 10 and the additive providing module 20. The common source of steam 50 may be operated such that the steam 15, 25 is pressurized between 3 and 30 bars, between 8 to 20 bars, or between 8 to 17 bars in the common source of steam 50. Furthermore, the common source of steam 50 may be operated such that the steam 15, 25 is at temperatures between 100° C. and 300° C. in the common source of steam 50.

The steam 15 and/or the steam 25 may be saturated or superheated steam. The superheated steam may be, but not limited to, generated by burning a fuel, (such as hydrogen based or hydrocarbon-based fuels), and injecting saturated steam or atomized water into or next to the burning fuel such that a temperature of the saturated steam or the atomized water is raised.

Figure 3:
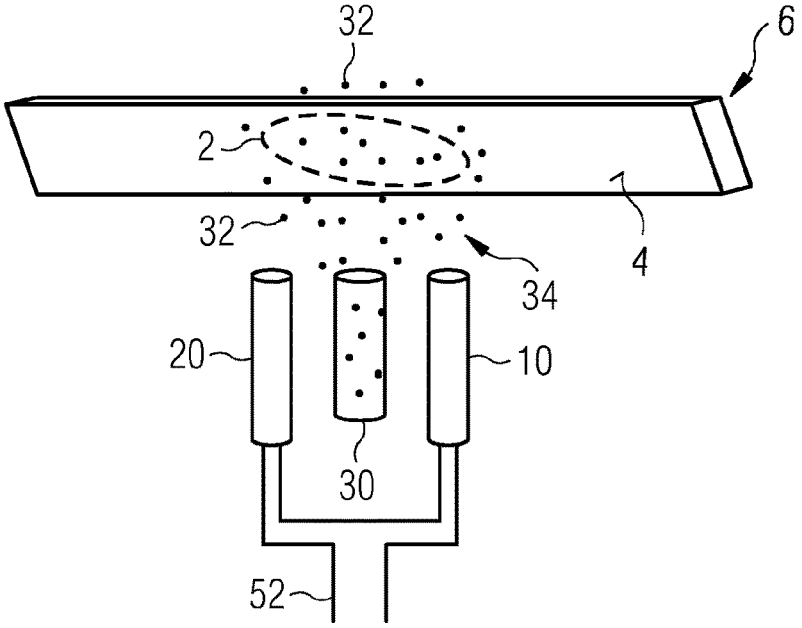
FIG. 3 schematically illustrates functioning of a component of an exemplary embodiment of the system.

Referring to FIG. 3 in combination with FIG. 1, another exemplary embodiment of the system 1 has been described. In this exemplary embodiment of the system 1, the system 1 also includes a pre-coating protection module 30. The pre-coating protection module 30 provides a non-reactive material 32 and/or a reducing material 32 to the part 2 of the surface 4 of the substrate 6. The non-reactive material 32 and/or the reducing material 32 is provided to the part 2 either along with abrasive blasting by the abrasive blasting module 10 or after the abrasive blasting is performed by the abrasive blasting module 10. The non-reactive material 32 and/or the reducing material 32 provided by the pre-coating protection module 30 covers or surrounds or envelops the part 2, by forming a protective environment 34 surrounding the part 2, such that the non-reactive material 32 isolates or seals of the part 2 from surroundings including ambient air, impurities, etc. When providing the reducing material 32, the reducing material 32 interacts with any oxidized forms of the substrate 6 and reduces the oxidized form before the additive 22 is provided to the part 2 to form the coating or the chemical conversion coating 27.

The pre-coating protection module 30 is designed as a module or unit or part of the system 1 having an opening or a nozzle (not shown) from which the non-reactive material 32 and/or the reducing material 32 is provided to the part 2 of the surface 4 and the surroundings of the part 2 of the surface 4. The pre-coating protection module 30 may include a non-reactive material supply 36 and/or a reducing material supply 36 where the non-reactive material 32 and/or the reducing material 32 is generated or stored. Furthermore, a non-reactive material supply line 38 and/or a reducing material supply line 38 may be present in the system 1 through which the non-reactive material 32 and/or the reducing material 32 is provided from the non-reactive material supply 36 and/or the reducing material supply 36, respectively, towards the part 2 of the surface 4. The non-reactive material 32, for example may be, but not limited to, a noble gas such as nitrogen, which when provided by the pre-coating protection module 30 covers the part 2 and the surroundings of the part 2 in the protective environment 34 or a cloud of the noble gas 32, as depicted in FIG. 3. The reducing material 32, for example may be, but not limited to, a reducing gas for an oxidized substrate, for example, such carbon mono-oxide gas for ferric oxide (oxidized form of iron substrate), which when provided by the pre-coating protection module 30 covers the part 2 and the surroundings of the part 2 in the protective environment 34 or a cloud of the reducing gas 32, as depicted in FIG. 3.

Figure 2:
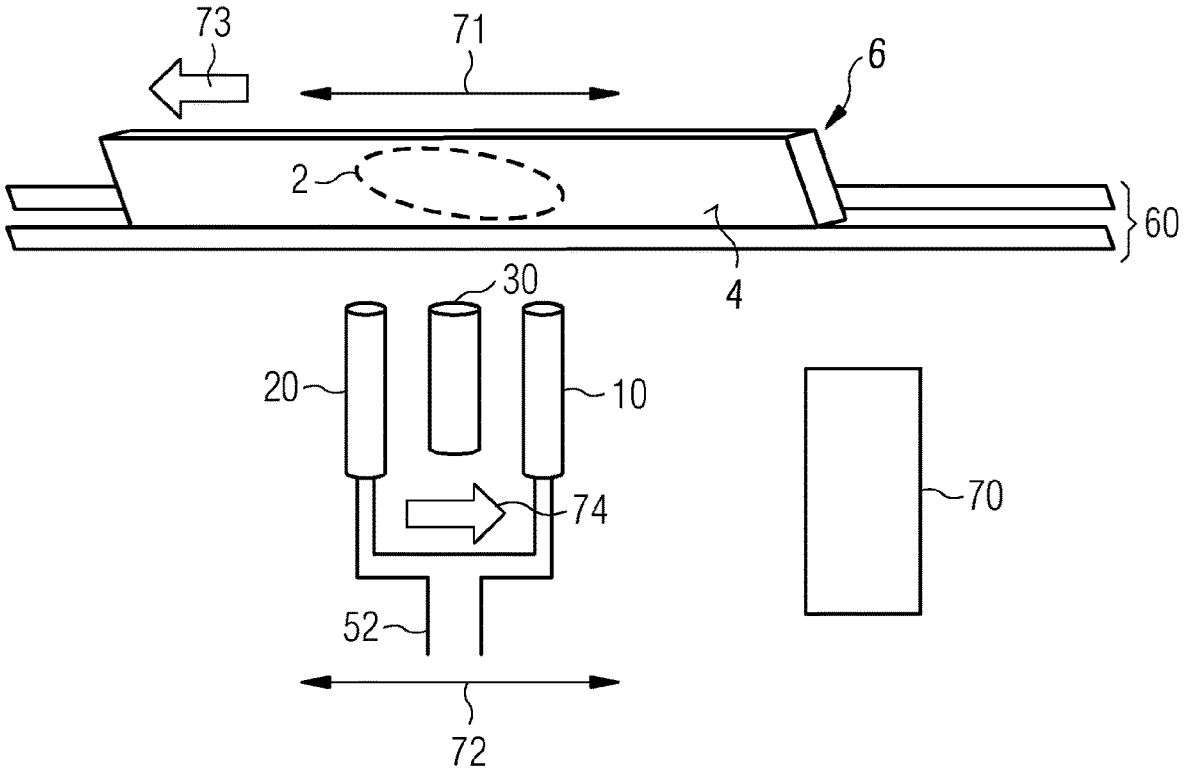
FIG. 2 schematically illustrates another exemplary embodiment of the system.

Referring to FIG. 2 in combination with FIG. 1, another exemplary embodiment of the system 1 has been described. In this exemplary embodiment of the system 1, the system 1 further includes a moving mechanism 70. The moving mechanism 70 implements a change in relative orientation between the part 2 of the surface 4 of the substrate 6 with respect to the abrasive blasting module 10 and the additive providing module 20. The abrasive blasting module 10 and the additive providing module 20 are in a fixed orientation relative to each other. One way of changing the relative orientation of the part 2 with respect to the abrasive blasting module 10 and the additive providing module 20 may be by moving only the part 2 along an axis 71 while the abrasive blasting module 10 and the additive providing module 20 remain stationary. Another way of changing the relative orientation of the part 2 with respect to the abrasive blasting module 10 and the additive providing module 20 may be by only moving the abrasive blasting module 10 and the additive providing module 20 together along an axis 72 and the part 2 remains stationary.

Yet another way of changing the relative orientation of the part 2 with respect to the abrasive blasting module 10 and the additive providing module 20 may be by a combination of simultaneously moving the part 2 along the axis 71 and moving the abrasive blasting module 10 and the additive providing module 20 along the axis 72, e.g., in opposite directions, such as depicted in FIG. 2, the part 2 is moved in a first direction 73 along the axis 71 whereas simultaneously the abrasive blasting module 10 and the additive providing module 20 are moved in a second direction 74, opposite to the first direction 71, along the axis 72. The moving mechanism 70 may include moving the substrate 6 or moving the abrasive blasting module 10 and the additive providing module 20 through a mechanism of motors and/or conveyors. In another exemplary embodiment, the system 1 may include a substrate slot 60. The substrate slot 60 receives the substrate 6 and maintains the substrate 6 at a desired orientation, such as the part 2 facing, and placed at a desired distance, from the abrasive blasting module 10 and the additive providing module 20. In an exemplary embodiment of the system 1, the moving mechanism 70 may move the substrate slot 60 and thus change the relative orientation of the part 2 with respect to the abrasive blasting module 10 and the additive providing module 20. Such moving mechanism with motors and/or conveyors is well known technique in manufacturing and fabrication assemblies and thus not described herein in more detail for sake of brevity.

It may be noted from combination of FIGS. 1 to 3, that the abrasive blasting module 10, the additive providing module 20 and the pre-coating protection module 30 may be arranged in any orientation relative to each other. For example, the pre-coating protection module 30 may be positioned in between the abrasive blasting module 10 and the additive providing module 20, as depicted in FIGS. 2 and 3, or may be positioned at a side of the abrasive blasting module 10 and the additive providing module 20, as depicted in FIG. 1. Furthermore, as depicted in FIGS. 2 and 3, the abrasive blasting module 10 and the additive providing module 20 may be positioned parallel to each other, or as depicted in FIG. 1, the abrasive blasting module 10 and the additive providing module 20 may be arranged at an angle to each other.

Figure 4:
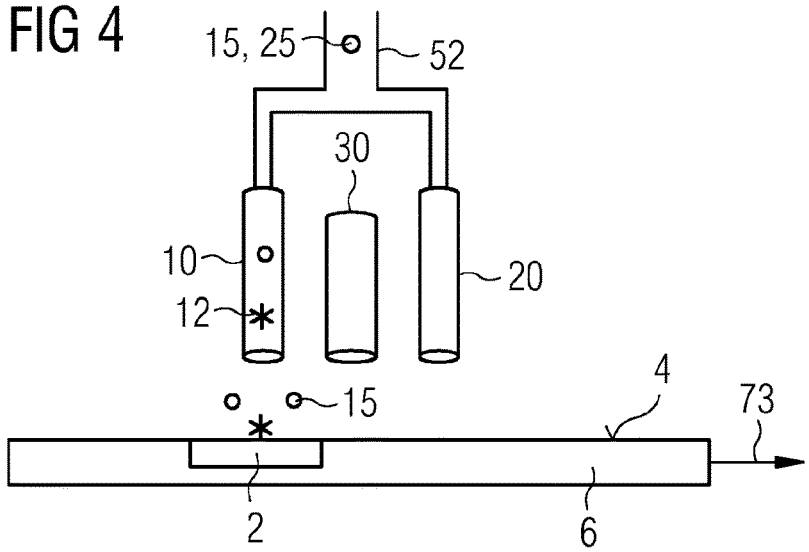
FIG. 4 schematically illustrates functioning of another exemplary embodiment the system.
Figure 5:
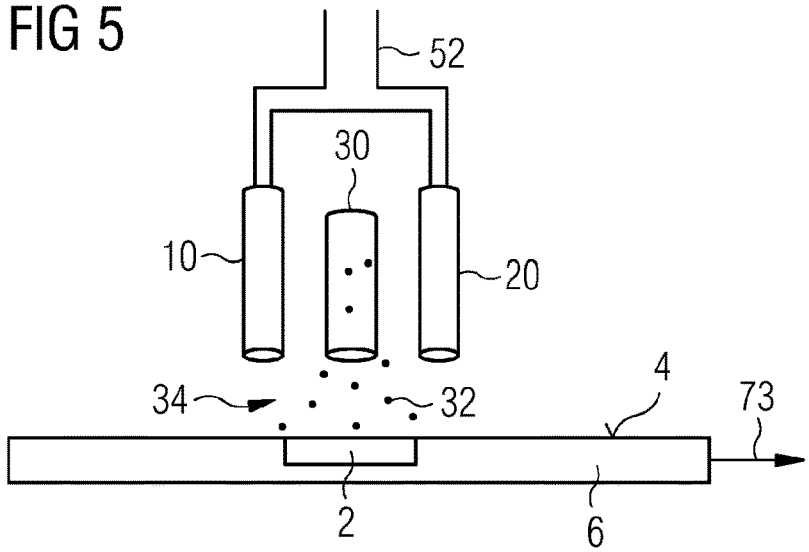
FIG. 5 schematically illustrates functioning of the exemplary embodiment of FIG. 4 of the system subsequent to the functioning depicted in FIG. 4.
Figure 6:
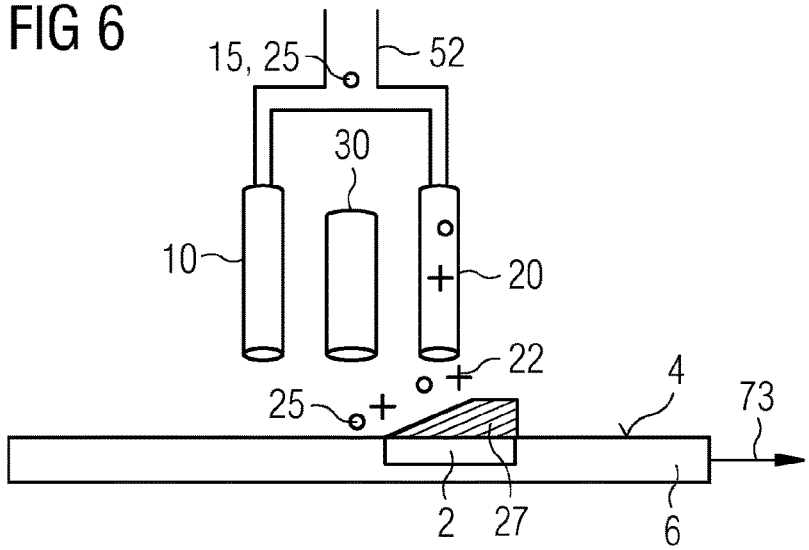
FIG. 6 schematically illustrates functioning of the exemplary embodiment of FIGS. 4 and 5 of the system subsequent to the functioning depicted in FIG. 5.

Referring now to FIGS. 4, 5, and 6 in combination with FIGS. 1, 2 and 3, a detailed working of the system 1 of an exemplary embodiment of the system 1 has been described. At the initiation of use of the system 1, as shown in FIG. 4, the part 2 is aligned such that the abrasive blasting from the abrasive blasting module 10 is performed on the part 2. At this stage, the additive providing module 20 and the pre-coating protection module 30 are not being operated. Then, the relative orientation of the part 2 is changed with respect to the abrasive blasting module 10 and the additive providing module 20, by moving part 2 in the direction 73, such that part 2 is now passing from a position of alignment with the abrasive blasting module 10 to a new position where it will be aligned with the additive providing module 20. This changing of the position has been depicted schematically in FIG. 5, during this time of changing the pre-coating protection module 30 forms the protective environment 34 surrounding the part 2. Finally, as depicted in FIG. 6, the part 2 reaches the new position where the part 2 is now aligned with the additive providing module 20 which forms the coating 27 on the part 2. The formation of the coating 27 is facilitated due to heating of the part 2 by the steam 15 and the steam 25 and also by the heating of the surrounding of the part by the steam 25 when the coating 27, which may include, but not limited to chemical conversion coating, is being formed.

Furthermore, though not depicted in FIGS. 4, 5 and 6, it may be understood by one skilled in the art that the system 1 of the present technique may be operated as an assembly line is operated, for example, by simultaneously operating the abrasive blasting module 10 and the additive providing module 20. When operated simultaneously, when the abrasive blasting module 10 has performed abrasive blasting on the part 2, subsequently, the part 2 is moved to align with the additive providing module 20, and while the additive providing module 20 performs on the part 2, another part (not shown), say a second part of the surface of the substrate may now be in alignment with the abrasive blasting module 10 which now may perform abrasive blasting on said another part while the additive providing module 20 is performing on the part 2.

Figure 7:
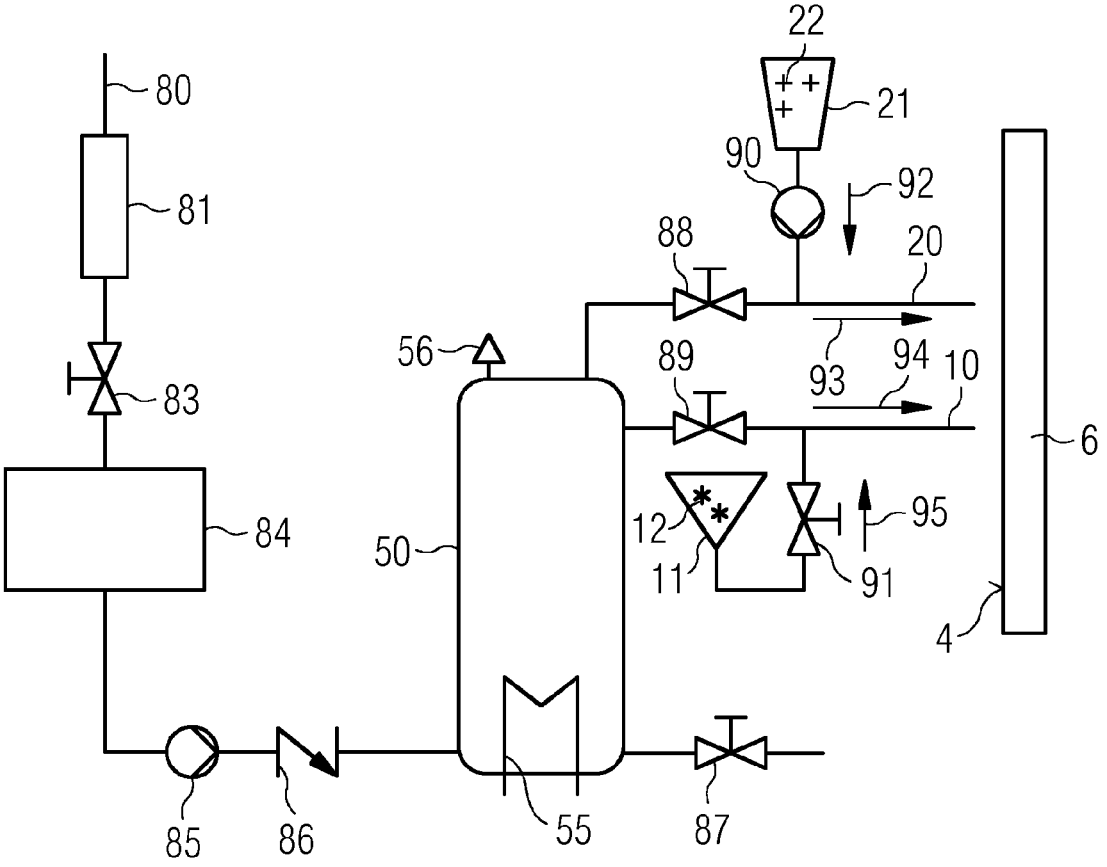
FIG. 7 schematically illustrates a detailed layout of an exemplary embodiment of the system.

Referring now to FIG. 7, a detailed layout of an exemplary embodiment of the system 1 is depicted. In the system 1, a water inlet 80 receives water (not shown), which is filtered and/or de-ionized by a water filtration unit 81 and collected subsequently in a water reservoir 84. A main valve 83 is used to control the flow of the water from the water filtration unit 81 to the water reservoir 84. Subsequently, with the help of a pump 85, the water from the water reservoir 84 is pumped into the common source of steam 50, e.g., the boiler 50. In between the pump 85 and the boiler 50, a check valve 86 is positioned to provide that the water flows in a desired direction only, e.g., from the water reservoir 84 to the boiler 50. The boiler 50 has a heating element 55 or a heater 55 using which the water is heated in the boiler 50 to generate the steam 15, 25 (shown in FIG. 1). The boiler 50 may be equipped with a blow off valve 87 and a safety relief valve 56. From the boiler 50, the steam travel towards the abrasive blasting module 10 and the additive providing module 20, passing through first and second line valves 89 and 88, respectively, which control the release of the steam 15 and 25. An abrasive supply 11 connects to the abrasive blasting module 10 and the abrasive media 12 is supplied to the steam 15 in an abrasive flow 95 before exiting the abrasive blasting module 10 at an abrasive ejection 94. The flow of abrasive media 12 is controlled through a valve 91 for the abrasive media 12. An additive supply 21 connects to the additive providing module 20 and the additive 22 is supplied to the steam 25 in an additive flow 92 before exiting the additive providing module 20 at an additive ejection 93. The flow of additive 22 is facilitated and/or controlled through an additive supply pump 90 for the additive 22.

Referring back to FIG. 8 in combination with FIGS. 1 to 7, the method 1000 has been described further.

In the method 1000, in act 110 the substrate 6 is provided. The substrate 6 may be a metallic substrate or a non-metallic substrate such as composite material. The metallic substrate 6 may include aluminum and/or magnesium, (e.g., an aluminum alloy or magnesium alloy). In the method 1000, the part 2 of the surface 4 of the substrate 6 is subjected to abrasive blasting in act 100. The abrasive blasting 100 includes providing the abrasive media 12 carried by the first carrier 14 to the part 2. The abrasive media 12 collides with the part 2 and causes abrasion to the part 2. The first carrier includes steam 15. The abrasive media 12 may include, but not limited to alumina grits, steel-based grits, quarts, silicon carbide, ceramic granules, and a combination thereof. In another embodiment of the method 1000, subsequent to act 100, in act 300, the additive 22 carried by the second carrier 24 is provided to the part 2. The additive reacts with the substrate and forms the coating or the chemical conversion coating 27 on the part 2. The second carrier 24 may include steam 25. In another embodiment of the method 1000, the steam 15 and the steam 25 are received from the common source of steam 50. The steam 15 and/or the steam 25 may be saturated or superheated steam. The superheated steam may be generated by burning a fuel having hydrogen or hydrocarbon and injecting saturated steam or atomized water into the burning fuel such that a temperature of the saturated steam or the atomized water is raised.

As aforementioned, the common source of steam 50 is operated at a pressure ranging between 3 and 30 bars, between 8 bars and 20 bars, or between 8 to 17 bars, in an exemplary embodiment of the method 1000. In a related embodiment of the method 1000, the common source of steam 50 is operated at a temperature ranging between 100° C. and 300° C. Furthermore, optionally in the method 1000, after act 100 and before act 300, in act 200, the protective environment 34 is provided to the part 2 by enveloping the part 2 with the non-reactive material 32 and or the reducing material 32. The elements such as the part 2, the surface 4, the substrate 6, first carrier 14, the second carrier 24, the steam 15, 25, the abrasive media 12, the additive 22, the non-reactive and/or reducing material 32, and so on and so forth used in explanation of FIG. 8 may be understood to be same as the elements with same reference numerals described in reference to FIGS. 1 to 7.

Although the disclosure has been illustrated and described in detail by the exemplary embodiments, the disclosure is not restricted by the disclosed examples and the person skilled in the art may derive other variations from this without departing from the scope of protection of the disclosure. It is therefore intended that the foregoing description be regarded as illustrative rather than limiting, and that it be understood that all equivalents and/or combinations of embodiments are intended to be included in this description.

It is to be understood that the elements and features recited in the appended claims may be combined in different ways to produce new claims that likewise fall within the scope of the present disclosure. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

The invention claimed is:

1. A method for modifying a surface of a substrate, the method comprising:

providing an abrasive media carried by a first carrier to a part of the surface of the substrate, wherein the first carrier comprises steam;

abrasive blasting the part of the surface of the substrate, wherein the abrasive media collides with the part of the surface and causes an abrasion to the part of the surface;

providing an additive carried by a second carrier to the part of the surface of the substrate, wherein the second carrier comprises steam; and forming a coating with the additive on the part of the surface of the substrate.

2. The method of claim 1, wherein the steam of the first carrier is saturated, the steam of the second carrier is saturated, or both the steam of the first carrier and the steam of the second carrier are saturated.

3. The method of claim 1, wherein the steam of the first carrier is superheated, the steam of the second carrier is superheated, or both the steam of the first carrier and the steam of the second carrier are superheated.

4. The method of claim 3, wherein the superheated steam of the first carrier and/or the superheated steam of the second carrier is generated by burning a fuel in form of a burning mixture and injecting saturated steam or atomized water into the burning mixture.

5. The method of claim 1, wherein the steam of the first carrier and the steam of the second carrier are received from a common source of steam.

6. The method of claim 5, wherein the common source of steam is operated at a pressure ranging between 3 bars and 30 bars.

7. The method of claim 5, wherein the common source of steam is operated at a temperature ranging between 100° C. and 300° C.

8. The method of claim 1, further comprising:

providing a protective environment to the part of the surface by enveloping the part of the surface with a non-reactive material, a reducing material, or both the non-reactive material and the reducing material.

9. The method of claim 1, further comprising:

providing the substrate, wherein the substrate is a metallic substrate.

10. The method of claim 9, wherein the metallic substrate comprises aluminum, magnesium, or a combination thereof.

11. The method of claim 1, wherein the abrasive media comprises alumina grits, steel-based grits, quartz, silicon carbide, ceramic granules, a polymer, or a combination thereof.

12. A system for modifying a surface of a substrate, the system comprising:

an abrasive blasting module configured to provide an abrasive media carried by a first carrier to a part of the surface of the substrate, wherein the first carrier comprises steam; and an additive providing module configured to provide an additive carried by a second carrier to the part of the surface of the substrate, wherein the second carrier comprises steam, wherein the additive is configured to interact with the substrate to form a coating on the part of the surface of the substrate, and wherein the abrasive blasting module and the additive providing module are in fluid communication with a common source of steam.

13. The system of claim 12, further comprising:

a moving mechanism configured to implement a change in relative orientation between the part of the surface of the substrate with respect to the abrasive blasting module and the additive providing module, wherein the abrasive blasting module and the additive providing module are in a fixed orientation relative to each other.

14. The system of claim 13, further comprising:

a pre-coating protection module configured to provide a non-reactive material, a reducing material, or both the non-reactive material and the reducing material to the part of the surface of the substrate such that the non-reactive material, the reducing material, or both the non-reactive material and the reducing material envelop the part of the surface of the substrate.

15. The system of claim 12, further comprising:

a pre-coating protection module configured to provide a non-reactive material, a reducing material, or both the non-reactive material and the reducing material to the part of the surface of the substrate such that the non-reactive material, the reducing material, or both the non-reactive material and the reducing material envelop the part of the surface of the substrate.

* * * * *